US005392592A

United States Patent [19]

Bozich et al.

[11] Patent Number: 5,392,592

[45] Date of Patent: Feb. 28, 1995

[54] HOT-MELT PRESSURE SENSITIVE ADHESIVE PACKAGING, PREFORM, AND METHOD

[75] Inventors: Frank Bozich, Clarendon Hills; Charles J. King, Stickney, both of Ill.

[73] Assignee: Croda Apex Adhesives, Inc., Itasca, Ill.

[21] Appl. No.: 216,799

[22] Filed: Mar. 23, 1994

Related U.S. Application Data

[63] Continuation of Ser. No. 949,465, Sep. 22, 1992, Pat. No. 5,333,439.

[51] Int. Cl.[6] ..... B65B 63/00

[52] U.S. Cl. ..... 53/440; 53/428; 53/469; 53/473; 53/450; 206/447; 206/524.1

[58] Field of Search ..... 53/122, 428, 440, 443, 53/469, 473, 450; 206/447, 524.1, 524.3, 524.7

[56] References Cited

U.S. PATENT DOCUMENTS 4,748,796 6/1988 Viel ..... 53/440
5,257,491 11/1993 Rouyer et al. ..... 53/440

OTHER PUBLICATIONS

Brochure by The Kartridge Pak Co. entitled, "The Chub Package Kartridge Pak® For Adhesives And Sealants," undated, pp. 1–4.

Brochure by The Kartridge Pak Co. entitled, "The Chub Package: It's Not Just For Sausage Anymore," reprinted from Packaging Digest, Jul. 1990.

Brochure by The Kartridge Pak Co. entitled, "Chub Packaging Machines By Kartridge Pak," undated, pp. 1–8.

Brochure by Eriez Manufacturing Co. entitled, "Eriez HI-VI Volumatic Feeder Machines," dated 1978.

*Primary Examiner*—W. Donald Bray
*Attorney, Agent, or Firm*—Marshall, O'Toole, Gerstein, Murray & Borun

[57] ABSTRACT

The present invention is directed to a method for the waste-free packaging for a hot-melt pressure sensitive adhesive that comprises extruding a hot-melt pressure sensitive adhesive into a continuous tubular film, wherein the film is compatible with being integrated into the composition of the hot-melt adhesive composition; and crimping the continuous tubular film at a predetermined distance such that a predetermined amount of the hot-melt pressure sensitive adhesive is isolated between at least two of the crimps to produce a compatibly packaged hot-melt adhesive composition. By melting the compatibly packaged hot-melt adhesive composition in a glue pot, the compatible packaging becomes compatibly integrated into the molten hot-melt adhesive composition.

5 Claims, 2 Drawing Sheets

HOT-MELT PRESSURE SENSITIVE ADHESIVE PACKAGING, PREFORM, AND METHOD

This is a continuation of U.S. application Ser. No. 07/949,465, filed Sept. 22, 1992, now U.S. Pat. No. 5,333,439.

BACKGROUND OF THE INVENTION

A. Field of the Invention

The present invention relates to releasable packaging for hot-melt pressure sensitive adhesive compositions and to a preform of the release packaging. More particularly, the present invention relates to a method for releasably packaging a hot-melt pressure sensitive adhesive in a continuous form-fill-seal mode. The present invention is useful because it permits a hot-melt pressure sensitive adhesive composition to be releasably packaged at high speed and in a variety of sizes to suit a customer's needs.

B. Background

Hot-melt adhesives are adhesives that are tacky when applied in the "hot-melt" or molten state. At room temperature, all hot-melt adhesives are solids. Hence, as a practical matter, all hot-melt adhesives are sold as solids, e.g., rigid blocks.

Hot-melt pressure sensitive adhesives ("pressure sensitives") are the class of hot-melt adhesives that are very tacky to the touch even at room temperature. As a solid, pressure sensitives create an adhesive bond upon contact with a substrate without the introduction of heat. These are desirable adhesive properties. However, these properties create a packaging problem. The pressure sensitive adheres to itself and to all traditional hot-melt packaging at room temperature. Current packaging for pressure sensitive includes the Hot-Flo drums of Grief Brothers, the silicone release coated cardboard folding boxes of Menasha Paper Company, the powdered plastic water immersed disposable multi-cavity trays, and H. B. Fuller's wax co-extrusion.

Packaging for pressure sensitives must provide the pressure sensitive in a form that can be put into the customer's glue pots for melting prior to application. All of the aforementioned packaging, except the Hot-Flo drums of Grief Brothers, are of sizes that provide a rigid block of pressure sensitive adhesive which can be hand inserted into the glue pots. With the Hot-Flo drums, a drum unloader pre-melts the solid pressure sensitive in the drum, and once molten, pipes it into the glue pots. The expense of using a drum unloader to heat, melt and dispense a drum of adhesive can be absorbed by and be efficient for only the largest users. These capital considerations make this form uncommon, even though the packaging costs only about $0.05 per lb. It is an object of the present invention to provide inexpensive packaging for pressure sensitives that allows them to be handled in sizes that are less than a drum. A second type of packaging for hot-melt pressure sensitive adhesives is the folding silicone lined carton of Menasha. Menasha's folding silicon lined cartons are expensive, costing about $0.19 per lb for a 2½ lb brick. Moreover, they are very labor intensive to both fold and fill. For example, the Menasha 2½ lb. brick carton has 26 fold lines. Further, the molten pressure sensitive adhesive that is filled into the Menasha carton must fully solidify before being master-packed and transported. This means that for a 2½ lb brick, a great deal of cooling time is required. These factors drive the packaging costs to well over $0.20 per lb. In addition, the purchaser of any pressure sensitive that is supplied in a silicone lined carton must handle a "naked" brick of the adhesive when inserting it into his glue pot. This can be dangerous.

The naked brick is very tacky and has been known to adhere to the hand while being eased into a glue pot containing the molten material. Use of the other hand to unstick the naked brick, which would have molten glue on the other end, has caused severe burns to the saving hand of glue pot operators. Another problem associated with use of the silicone lined carton is that the user must dispose of a large number of empty cartons which are not recyclable and create a voluminous amount of refuse.

It is an object of the present invention to provide a packaging for pressure sensitives that allows the pressure sensitive adhesive to be safely handled in its solid form without tack. It is another object of the present invention to provide a packaging for pressure sensitives that produce a minimal amount of refuse.

An alternative packaging system for pressure sensitives is the multi-cavity plastic immersion tray. These multi-cavity trays, which resemble large sized one piece ice cube trays, provide improved handling characteristics over the silicone lined cartons. The multi-cavity trays are first powdered to reduce handling surface tackiness. They are then immersed in a cooling trough as they are filled within a molten pressure sensitive by a metered extrusion head. The filled trays are conveyed in the fluid until the pressure sensitive solidifies into a rigid brick and then cools to a transportable temperature. Finally, the solidified adhesive in the cavities are top-dusted and master-packed for shipment. The customer removes the bricks by inverting and deforming the cavity. The powdered bricks are less tacky on the surface than Menasha-type bricks, but are inserted into the glue pots the same way because they are less labor intensive and quicker to fill. The powdered bricks are commonly smaller bricks than the "naked" bricks, i.e., about 1 lb instead of 2½ lb.

The problem with the multi-cavity trays is the necessity of the cooling/conveyance system which is unique to pressure sensitives and requires huge capital investment by the producer. Such an investment is typically only made by the larger adhesive manufacturers. It is an object of the present invention to provide a packaging system that is both inexpensive and that avoids the conveyance of the packaged product in a liquid cooling system.

Another problem with the multi-cavity trays is that they must be both thick and strong enough to avoid melting when filled, yet dissipate heat quickly enough to allow full cooling by the line's end. Such trays are costly. Investment in a die to form the trays can also run $40,000. These expenses end up driving the packaging costs of this process up to about $0.15 per lb. Further, the trays are typically not recycled back to the manufacturer and again produce a voluminous amount of waste for the end user. It is an object of the present invention to eliminate this voluminous packaging waste.

Another process for packaging a pressure sensitive is co-extrusion. In co-extrusion, wax or some tack-free coating is co-extruded around a short core ("pillow") of pressure sensitive adhesive glue. This process makes the extruded pillow form non-tacky, and hence it can be packaged by more traditional methods. These short pinched "pillows" of pressure sensitive are easily scoop loaded into the customer's glue pots. A problem with the co-extrusion process is that a large capital investment is needed to purchase the co-extrusion equipment and the equipment is complex to operate. It is an object of the present invention to develop a packaging for pressure sensitives that does not require the large capital investment associated with co-extrusion equipment.

SUMMARY OF THE INVENTION

The present invention is directed to a method, a package and a preform for releasably packaging any hot-melt pressure sensitive adhesive composition. The release packaging of the present invention is capable of being used by both the small and the large manufacturers of pressure sensitive adhesives. Further, the release packaging generates minimal waste for the end user.

The release packaging of the present invention was further improved by the discovery that the polymeric film that is utilized to produce the preform of the present invention is capable of selectively binding a micronized powder to a silicone coating on its surface. Thus, by controlling the pattern of silicone placement on the polymeric film, one can control the subsequent placement of the micronized powder to those areas of the polymeric film that are not involved in forming a heat seal.

Stated more particularly, the present invention is directed to a preform for the release packaging of a hot-melt pressure sensitive adhesive composition comprising a continuous sheet of a heat sealable film having two opposing edges, namely a first edge and an opposite edge. The continuous sheet has a patterned silicone coating on at least one face wherein the patterned silicone coating is such that an area along at least one of the edges on the silicone coated face remains uncoated, such that the uncoated edge is capable of forming a heat seal with an uncoated area in proximity to the opposite edge. The uncoated area in proximity to the opposite edge may be on the same coated face as the uncoated area along the first edge or it may be on the opposite face. The patterned silicone coating further has the capacity to adhere thereto an amount of a micronized powder that is effective to provide releasable contact between the silicone coated and powdered face and a hot-melt pressure sensitive adhesive in contact therewith.

In another aspect, the present invention is directed to a release package for a hot-melt pressure sensitive adhesive of the present invention. The release package comprises a tubular film formed from a heat sealable polymeric material, the tubular film being heat sealed longitudinally, the tubular film having an inside surface and an outside surface, substantially all of said inside surface being silicone coated and being capable of adhering a micronized powder to the silicone coating. The tubular film is also capable of receiving a hot-melt pressure sensitive adhesive composition, and is also capable of being crimped so as to isolate and releasably package between two of the crimps a predetermined amount of hot-melt pressure sensitive adhesive.

Preferably, the silicone coated interior of the release packaging is further coated with a micronized powder such that the tubular film is capable of both receiving and powder coating a hot-melt pressure sensitive adhesive composition. Upon crimping the tubular film, the resulting hot-melt pressure sensitive adhesive composition is both releasably packaged and safely handleable (i.e., non-tacky) upon removal from the release packaging.

Finally, the present invention is directed to a method for releasably packaging a hot-melt pressure sensitive adhesive composition comprising the steps of:

a. forming a preform by coating a continuous sheet of heat sealable film along at least one face with a silicone coating, said continuous sheet having two opposing longitudinal edges, namely, a first longitudinal edge and an opposite longitudinal edge, said coating providing a pattern such that an area along the first edge of the coated face remains capable of forming a heat seal with a second uncoated area in proximity with the opposite edge on either face;
b. heat sealing the uncoated area along the first edge of the preform to an uncoated area along the opposite edge of the preform to form a continuous tubular film capable of receiving an extruded hot-melt pressure sensitive adhesive therein;
c. extruding a hot-melt pressure sensitive adhesive into the continuous tubular film at a predetermined rate; and
d. crimping the continuous tubular film at a predetermined distance such that a predetermined amount of the extruded hot-melt pressure sensitive adhesive is isolated between at least two of the crimps, whereby upon cooling, the isolated predetermined amount of hot-melt pressure sensitive adhesive is releasably packaged between at least two of said crimps.

Preferably, the method of the present invention further comprises between Steps (a) and (b) the step of:

adhering a micronized powder to the siliconized coating of the continuous sheet to form a siliconized and powdered preform. In this embodiment, the continuous tubular film that is formed in the heat sealing step from the siliconized and powdered preform is capable of both receiving and powder coating a hot-melt pressure sensitive adhesive that has been extruded therein. Further, the predetermined amount of hot-melt pressure sensitive adhesive that is isolated in the crimping step is also powder coated and releasably packaged.

DETAILED DESCRIPTION OF THE INVENTION

Figure 1:
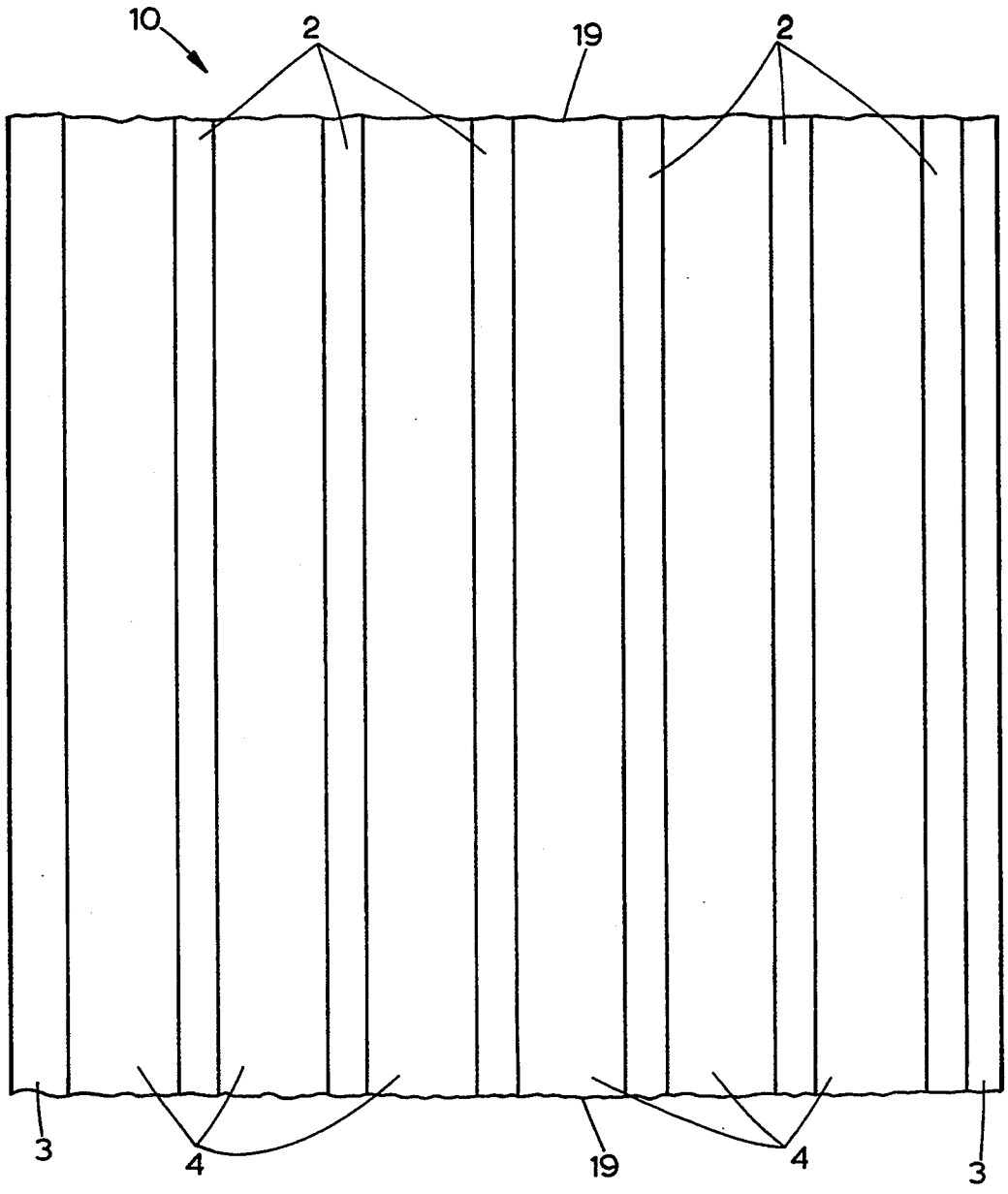
FIG. 1 discloses a broken cross-section of a master roll having six preforms of the present invention patterned thereon.

The present invention has three aspects. In its first and simplest aspect, the present invention is directed to a preform of a release package that is used to releasably package a hot-melt pressure sensitive adhesive. The preform of the present invention comprises a continuous sheet of a heat sealable film, having two opposing longitudinal edges, namely a first edge and an opposite edge, and two opposing faces, the continuous sheeting having a patterned silicone coating on at least one face wherein the patterned silicone coating is such that an area along at least the first of the opposing edges on said silicone coated face remains uncoated, such that the uncoated area along the first edge is capable of forming a heat seal with a second uncoated area (on either face) in proximity to the opposite edge, the continuous coated sheet further having a proximal end and a distal end, the silicone coating of said proximal end further having the capacity to adhere thereto an amount of a micronized powder that is effective to provide a releasable contact between a hot-melt pressure sensitive adhesive in contact with said silicone coated and powdered face.

The preform of the present invention utilizes, as a component, a continuous sheet of heat sealable film. By the word "continuous", as used herein, is meant that the sheet is long and capable of forming a plurality of releasable packages for a hot-melt pressure sensitive adhesive. Preferably, the continuous sheet of heat sealable film is provided on a roll.

The heat sealable film may be any single-ply or multi-ply polymeric material that has sufficient heat resistance and strength to accept and contain a volume of molten hot-melt pressure sensitive adhesive without melting or tearing. The melting point for pressure sensitive adhesives varies depending upon their individual composition. However, as a general rule, their processing temperatures range from about 240° F. to about 300° F. On occasion, the melting point of a heat sealable film or one of its plys may be at or near the processing temperature for the hot-melt pressure sensitive adhesive. To accommodate the high processing temperatures of some pressure sensitive adhesives, it is within the scope of the present invention to use a cooling spray or a cooling ring to maintain the integrity of the heat sealable film. This option is more fully discussed in the process of the present invention.

The heat sealable film of the preform must also be capable of being sealed by the application of heat or a hot-melt adhesive. In the latter embodiment, the heat sealable film may have a hot-melt adhesive applied in a hot-melt state along one of its uncoated edges such that when the adhesive bearing edge is folded over in contact with an opposing uncoated edge and heat activated, a bond is formed between the opposing edges.

Preferably, the heat sealable film is a continuous sheet of a single-ply or multi-ply polymeric material that is capable of being self sealed (i.e., without the application of an adhesive) by the application of an appropriate amount of heat. Techniques for the heat sealing of a heat sealable film are well known in the art. For example, heat sealing may be accomplished by directing a narrow stream of hot air onto an area of overlap between the film surfaces to be sealed. Alternatively, the area of overlap may be continuously sealed by the application of a radio frequency dielectric heat (RF).

Suitable polymeric materials for a single-ply heat sealable film, include the low density and medium density polyethylenes. For example, the heat sealable film may be a continuous sheet comprising a single layer of polyethylene. However, the heat sealable film is preferably a laminate composed of several polymeric layers wherein the exterior layer of one or both faces of the sheet has a lower melting point than the interior layer or layers. This format allows the exterior layers to be heat sealable relative to the higher melting point interior layer(s) which are capable of conferring overall thermal resistance to the film. Suitable polymeric materials for use as one or more interior layers include polyesters, polystyrene, polypropylene and combinations thereof. Of the polyesters, polyethylene terephthalate is preferred.

On occasion, the interior and exterior plys for a laminate heat sealable film may not be compatible with one another, i.e., they will not bond directly to form a laminate. In such instances, it is within the scope of the present invention to utilize a compatibilizing agent to cause bonding to occur. The use of compatibilizing agents is well known in the art.

A preferred heat sealable film is a three-ply laminate wherein the two outer plys are heat sealable and the inner ply is heat resistant.

An especially preferred heat sealable film is a three-ply film laminate comprising polyethylene/polyethylene terephthalate/polyethylene ("PE/PET/PE"). In this film, the two outer faces (plys) are medium density polyethylene, which is heat sealable, whereas the inner ply is polyethylene terephthalate, which has a higher melting point (mp) and is capable of conferring thermal resistance to the heat sealable film. The three-ply laminate of PE/PET/PE is commercially available from a variety of film manufacturers, such as Flexicon, Inc., Cary, Ill.

The continuous sheets of heat sealable film must be of sufficient thickness to confer strength, heat resistance, and heat sealability. The choice of thickness for any single sheet or multiple-ply laminate is dependent not only upon the processing temperature of the pressure sensitive but also upon the choice of polymeric material(s) in the polymeric film. For example, in the three-ply laminate, the outer plys should be of sufficient thickness to provide an effective heat seal whereas the inner ply of a three-ply laminate should be of sufficient thickness to confer strength and/or heat resistance. One of ordinary skill in the art could experiment with different thicknesses of a heat sealable ply to determine a thickness that provided effective results.

By way of example, a three-ply laminate composed of PE/PET/PE, wherein the exterior plys which were each 1 mil thick medium density polyethylene, provided good heat seal results. Plys of medium density polyethylene having a thickness of 0.5 mil or greater would also be expected to also provide effective heat seals in this three-ply laminate. However, no particular advantage would appear to be gained by using polyethylene plys thicker than 1 mil.

In the three-ply laminate composed of PE/PET/PE, an interior ply of PET having a thickness of 1.6 mil was found to confer effective strength and/or heat resistance. Depending upon the need for lesser or greater heat resistance, one could select a thinner or a thicker PET ply, such as between 0.5–4 mil.

In the preform of the present invention, the heat sealable film must be silicone coated. Techniques for the silicone coating of polymers are well known in the art. Moreover, they are commercially available, such as available from Release Technologies, Inc., West Chicago, Ill. Such techniques include the zone coating and the electron beam curing of the silicone coated heat sealable film. In zone coating, a surface of a continuous sheet (e.g., a roll) of a heat sealable film that is to be coated, is fed past a silicone coating device that is capable of applying a silicone coating to all or part of the surface passing by it. A silicone coating can be precisely applied in a variety of patterns, including as a thin line or a stripe running the length of the continuous sheet. The stripe may be of any preselected width including as wide as the continuous sheet itself. However, for purposes of this invention, the silicone coated stripe should be less than the width of the continuous sheet such that an uncoated stripe, preferably along at least one of the edges, more preferably, having a width between 0.5 and 0.75 inches, is available for heat sealing.

A preferred technique for the pattern or zone silicone coating of a heat sealable film with silicone utilizes a continuous sheet of the film that is substantially wider than the size of the preform. This wider form is called a master roll. For example, for an 8.55" wide preform, one could use a master roll of a heat sealable film of sufficient width (e.g., 53.3") to pattern coat six preforms side by side simultaneously on the master roll. (e.g., FIG. 1). FIG. 1 is a cross-section of a master roll between broken edges 19. In the embodiment of FIG. 1, the master roll 10 has six pairs of zones repeating themselves across the width of the continuous sheet. Each pair of zones, comprising a silicone coated zone 4 and an uncoated zone 2, corresponds to the width of a single preform. Any additional width in the master roll over that of the preforms is designated as trim zones 3. After silicone coating and curing, the master roll is cut to produce six working rolls, each corresponding to one embodiment (FIG. 2) of the preform of the present invention.

Figure 2:
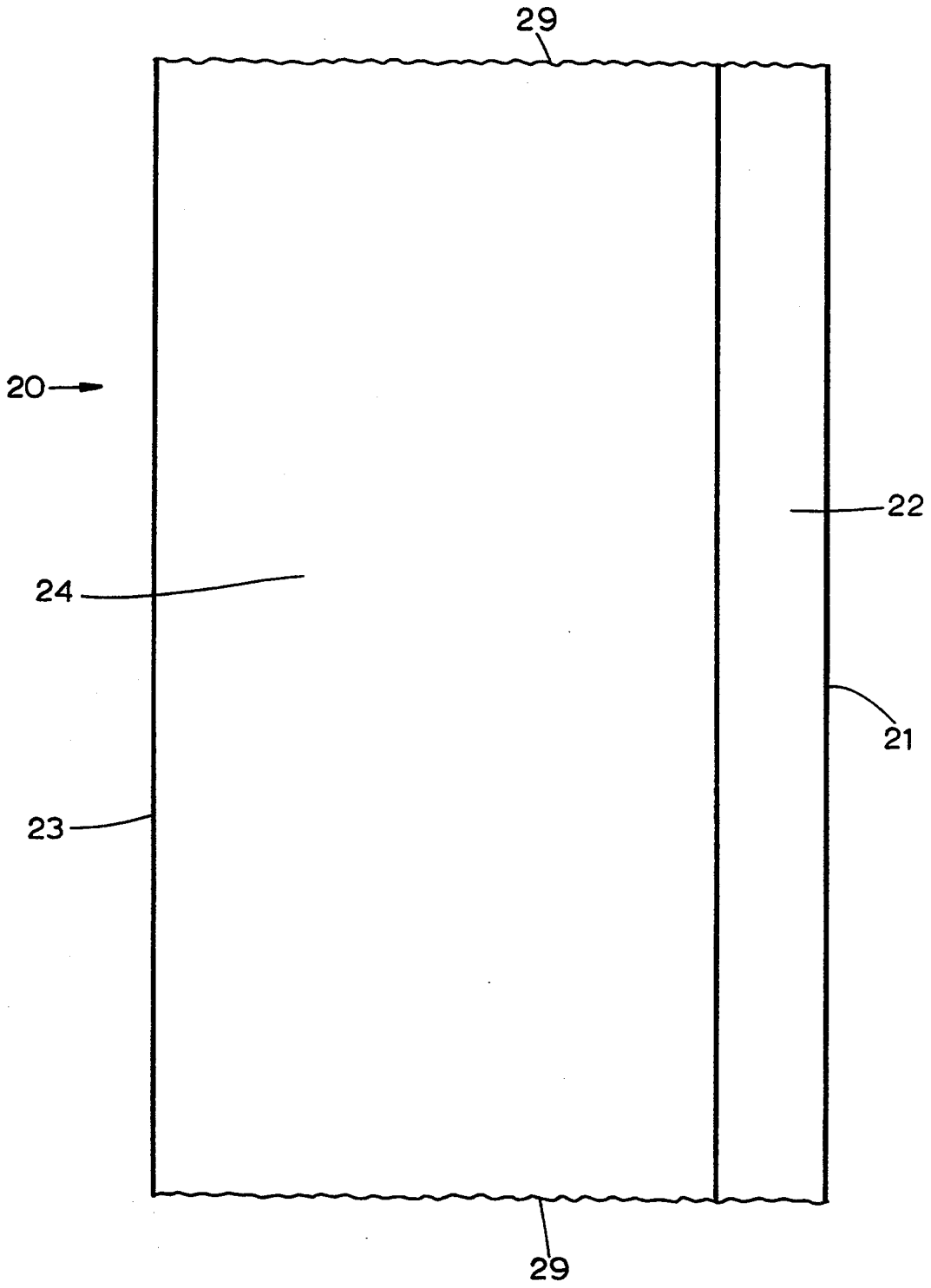
FIG. 2 discloses a broken cross-section of one embodiment of a preform of the present invention, such as cut from the master roll of FIG. 1.

FIG. 2 is a cross-section of one embodiment of a preform 20 between broken edges 29. The preform 20 has two opposing longitudinal edges, namely a first edge 21 and an opposite edge 23. The preform also has an uncoated zone 22 that is positioned along the first edge 21 and a silicone coated zone 24 that is positioned along the opposite edge 23. The uncoated zone 22 is of sufficient width, such that when folded over as to overlap an uncoated area along the opposite edge and opposite face, an effective heat seal could be formed between the uncoated areas. Preferably, the width of the uncoated zone 22 is not larger than needed to form a heat seal.

In an alternative embodiment that is not shown, there are two uncoated zones on the same face of the preform. Each of the two uncoated zones is positioned in proximity to one of the two opposing edges respectively of the continuous sheet of heat sealable film. Preferably, one uncoated zone is positioned along each of the two respective longitudinal edges. A silicone coated zone is positioned between the two uncoated zones. In this embodiment, the two uncoated zones are of sufficient width such that when folded forward as to be in overlapping contact with one another, there is sufficient overlap of the uncoated areas that an effective heat seal is capable of being formed.

The silicone coating on the preform of the present invention permits the interior surface of any tubular film produced therefrom to be silicone coated. In certain applications, the silicone coating is sufficient to produce a releasable packaging for a hot-melt pressure sensitive adhesive. However, it was unexpectedly discovered that the silicone coating that was applied to the heat sealable film provided the silicone coated area with the further capability of selectively binding a micronized powder upon contact. In contrast, the same micronized powder would not adhere to any appreciable extent upon the uncoated areas.

The micronized powders that are suitable for use with the present invention must be of sufficiently small size to be capable of being bound (i.e., adhering) to the silicone coating. Further, they must be of sufficiently small size so as to preclude their interference with either the bonding of the pressure sensitive or the equipment used to apply the pressure sensitive. Suitable micronized powders include powders of the synthetic waxes, the polyethylene waxes, the polypropylene waxes and a combination of polytetrafluorethylene and polyethylene waxes, wherein the mean particle size was within the range of 1–100 microns, preferably within the range of 1–25 microns. The above described micronized powders have a melting point between 145° F. and 400° F. and are commercially available in a variety of suitable sizes and grades from sources, such as Micro Powders, Inc., Tarrytown N.Y., and Kraft Chemical Co. Melrose Park, Ill. Micronized powders that would also be expected to be effective in the present invention include talc and calcium carbonate, also having a mean particle size within the range of 1–100 microns.

Preferred micronized powders are the synthetic waxes. Especially preferred synthetic waxes are the straight chain hydrocarbon synthetic waxes, such as produced by the Fischer-Troepsch process, and having melting points within the range of 215°–230° F. and mean particle sizes within the range of 1–25 microns.

This discovery relating to the selective binding of micronized powders provides additional advantages to the (silicone coated) preform of the present invention. Standing alone, the silicone coating of the preform of the present invention permits the interior surface of any tubular film produced therefrom to be completely silicone coated. In certain instances, a silicone coated tubular film may be sufficient to produce a releasable package for hot-melt pressure sensitive adhesives of moderate tack. However, it was also discovered that the silicone coating on the interior surface of the tubular film further enables the interior surface of the tubular film to retain a further coating of a micronized powder. In turn, the micronized powder is capable of being transferred to the surface of any molten pressure sensitive adhesive with which it comes in contact, thereby precluding even the most tacky pressure sensitive from sticking to the packaging or the hand of a glue pot operator.

Thus, in another aspect, the present invention is directed to a release packaging for hot-melt pressure sensitive adhesives. In its simplest embodiment, which is non-powdered, the release packaging comprises a tubular film formed from a heat sealable polymeric material that has been heat sealed longitudinally along opposing edges, said tubular film having an inside surface and an outside surface, the inside surface being silicone coated and capable of providing releasable contact with a hot-melt pressure sensitive adhesive, said tubular film being capable of receiving a predetermined amount of a hot-melt pressure sensitive adhesive composition, the tubular film also being capable of being crimped so as to isolate and releasably package a predetermined amount of hot-melt pressure sensitive adhesive between two of the crimps.

More preferably, the release packaging of the present invention has a micronized powder selectively bound to its silicone coating. In this embodiment, the release packaging comprises a tubular film formed from a heat sealable polymeric material that has been heat sealed longitudinally along opposing edges, said tubular film having an inside surface and an outside surface, said inside surface being silicone coated and having a micronized powder adhering thereon, said tubular film being capable of receiving and powder coating therein a predetermined amount of a hot-melt pressure sensitive adhesive composition, the tubular film also being capable of being crimped so as to isolate and releasably package the predetermined amount of hot-melt pressure sensitive adhesive between two of the crimps.

Regardless of its embodiment, the release packaging of the present invention is produced from the preform of the present invention. To produce the powder coated release packaging, the proximal end of the preform is fed toward a heat sealing machine with its silicone coated side in receiving relationship for a micronized powder. The micronized powder is then fed onto the silicone coated side of the preform. This step is accomplished using a vibratory feed machine which is capable of providing a flow of dry bulk material at a measured discharge rate. Vibratory feed machines are commercially available from manufacturers such as Eriez Magnetics Ontario, Canada. See also U.S. Pat. Nos. 2,895,064 and 2,997,158 both of which are assigned to Eriez and incorporated herein by reference.

The non-adhering micronized powder can be made to fall off the uncoated area of the preform by changing the direction of feed of the preform, such as by causing a horizontally fed preform to vertically ascend. The result is a preform having micronized powder adhering to its silicone coated zone but not the uncoated zones.

Depending upon the embodiment of the release packaging sought to be produced, a preform (with or without the micronized powder adhering to its silicone coating) is fed to a chub packaging machine, such as commercially available from the Kartridge Pak Co., Davenport, Iowa. (Chub packaging is most commonly known as the polymeric tubular packaging in which liver sausage is commercially available). A chub packaging machine is a machine that is used to continuously form, fill, and seal viscous materials including foods, caulk and the like. Applied to the present invention, a chub packaging machine is capable of forming a continuous tubular film from the preform by continuously bringing together, overlapping, and heat sealing the respective uncoated areas along opposing edges of the preform.

For the preform embodied in FIG. 2, the chub packaging machine would continuously cause the uncoated area along the first edge to fold over the silicone coated face and overlap a corresponding uncoated area on the opposite face and along the opposite edge. At or shortly after the time of their overlap, uncoated areas of the opposing edges are heat sealed, so as to continuously form a tubular film having an inside surface that is silicone coated with a micronized powder adhering thereto.

The tubular film of the present invention may also be formed from alternate embodiments of the preform, such as a preform having an uncoated area running longitudinally in proximity to (more preferably, along) each of the opposing edges with a silicone coated area between them. In this embodiment, a chub packaging machine would continuously bring the two uncoated areas along the opposing edges of the same face into an overlapping contact and form a heat seal between them, thereby continuously forming a tubular film. As in all embodiments of the invention, the overlap is made such that the silicone coated area forms the inside face of the tubular film.

Alternatively, a molten hot-melt adhesive could be continuously applied to the uncoated area along the first edge which would then be folded over to overlap and adhesively bond to the uncoated area on the opposite face and along the opposite edge.

Regardless of how the tubular film was formed, the method of formation would be such that all or substantially all of the inside surface of the tubular film would be silicone coated, more preferably, both silicone coated and powder coated. By the phrase "substantially all," as used in connection with the amount of inside surface that is coated, is meant that sufficient inside surface is silicone coated (more preferably, both silicone coated and powder coated) to releasably package a hot-melt pressure sensitive adhesive thereon, particularly in a continuous form-fill-seal mode.

Thus, in another aspect, the present invention is directed to a method for releasably packaging a hot-melt pressure sensitive adhesive, particularly in a continuous form-fill-seal mode. In its simplest form, the method for releasably packaging a hot-melt pressure sensitive adhesive has been described in the summary of the invention.

Preferably, the method for releasably packaging a hot-melt pressure sensitive adhesive utilizes a micronized powder and comprises the steps of:

a. providing a continuous sheet of heat sealable film having two opposing longitudinal edges, the continuous sheet being pattern coated with silicone on at least one face such that an area along the first edge of the coated face remains uncoated and capable of forming a heat seal with a second uncoated area in proximity with the opposite edge on either face;
b. adhering micronized powder to the siliconized coating of the continuous sheet to form a siliconized and powdered preform;
c. heat sealing the uncoated area along the first edge of the preform to an uncoated area along the opposite edge of the preform to form a continuous tubular film capable of releasably receiving an extruded hot-melt pressure sensitive adhesive therein;
d. extruding a hot-melt pressure sensitive adhesive into said continuous tubular film at a predetermined rate; and
e. crimping said continuous tubular film at a predetermined distance such that a predetermined amount of the hot-melt pressure sensitive adhesive is isolated between at least two of the crimps, whereby upon cooling, the isolated predetermined amount of hot-melt pressure sensitive adhesive is releasably packaged as a handleable solid between at least two of the crimps.

Steps (a) through (c) have already been discussed above in relation to the method of forming the continuous tubular film from the preform of the present invention. Step (d) of the method for releasably packaging a hot-melt pressure sensitive adhesive is directed to extruding a hot-melt pressure sensitive adhesive at a predetermined rate. The extruding step may be accomplished in a variety of ways.

One way to perform the extruding step would be to utilize a device which is well known in the art as an extruder. An extruder is a device that is capable of pumping out molten polymeric materials, including plastics and adhesives, at a controllable rate and a controllable temperature using a screw drive. Extruders are commercially available from equipment manufacturers such as Welex Instruments, Blue Bell, Pa.

Alternatively, the extruding step is accomplished by a metering pump connected to a tank having a molten hot-melt pressure sensitive adhesive therein. The metering pump extrudes the molten hot-melt pressure sensitive adhesive out of the heated glue tank and through a mandrel at a controllable rate. The mandrel is positioned inside the formed tubular film to direct the extruded adhesive therein.

In its simplest form, the extruding step may be accomplished by opening a spigot at or near the bottom of a heated glue tank by a predetermined amount and allowing the force of gravity to cause the molten pressure sensitive to be extruded into the tubular film at a predetermined rate. The spigot should be of sufficient size and shape to fit into the formed tubular film. Optionally, the spigot may be connected to a compatible hose and/or a sufficiently sized mandrel. In this embodiment, the predetermined rate of flow will be somewhat greater when the glue pot is full as opposed to when it is near empty. These differences are not significant in the method of the present invention and are easily accommodated by either adjusting the rate of formation of the continuous tubular film, or by adjusting the spigot opening.

Preferably, the hot-melt pressure sensitive adhesive extruded, via a metering pump, such as a variable speed positive displacement metering pump, which controls the product flow rate. The combination of a predetermined and continuous product flow rate coordinated with a predetermined and continuous tubular film formation rate enables the method to produce precise and reproducible package weights and lengths.

In the extruding step, the molten hot-melt pressure sensitive adhesive is extruded into the continuous tubular film at a predetermined rate. The predetermined rate must be sufficiently fast to provide an adequate fill of the tubular film but not so full as to cause the tube to burst during the subsequent crimping step.

The final step in the method for releasably packaging a hot-melt pressure sensitive adhesive is the crimping step. The crimping step is directed to crimping the filled continuous tubular film at a predetermined distance such that a predetermined amount of the extruded hot-melt pressure sensitive adhesive is isolated between at least two of the crimps. The function of the crimping step is that upon cooling, the isolated predetermined amount of the hot-melt pressure sensitive adhesive between at least two of the crimps is releasably packaged and is a handleable (non-tacky) solid.

Crimping the filled tubular film at predetermined distances may be accomplished by a variety of means. For example, a conventional chub packaging machine has a crimping mechanism known as "voider rolls" which are timed to void a semi-viscous product from the plastic tube area to be clipped. In the method of the present invention, a chub packaging machine was used to void the molten adhesive in the tubular film at some predetermined distance. It is within the scope of the present invention that the predetermined distance may be a function of crimping the moving tubular film at a predetermined time. The result is manifest as a predetermined distance on the tubular film.

Simultaneously with or after the actual crimping, the loose packaging in the crimped (i.e., voided) area is gathered and a pair of closures adjacently installed to maintain the crimp. Typically, the pair of closures is a pair of wire closures, i.e., closures that have been cut from a spool of wire. In this embodiment of the continuous form-fill-seal mode, the lower metal closure of the pair would be the top closure of one tubular release package containing a predetermined amount of a hot-melt pressure sensitive isolated therein. In contrast, the upper metal closure of the pair would be the bottom metal closure of the next release package to be formed from the continuous tubular film and also to contain a predetermined amount of pressure sensitive adhesive therein. By cutting the crimped area between each adjacent pair of closures, an individual release package containing a predetermined amount of hot-melt pressure sensitive adhesive therein is separated from the continuous tubular film.

In yet another embodiment, only a single closure is applied at the crimp sites. In this embodiment, no cut of the continuous film is made until some predetermined number of pressure sensitive extrudates (e.g., 1000 1 lb blocks, bars, slugs, or pillows) (hereinafter "blocks or bars") have been releasably packaged. The resultant release packaging is a continuous string of release packages connected to one another at the crimp sites, each release package having a predetermined amount of a pressure sensitive adhesive isolated and releasably packaged between the crimp sites. In this embodiment, the releasable packaging of the present invention resembles a series of sausage links connected in series.

Regardless of the embodiments, upon cooling, the isolated predetermined amount of pressure sensitive adhesive is a releasably packaged solid between two of the crimps.

In yet another embodiment, the crimping step may be performed by chilled voider rolls. The chilled voider rolls would perform two functions. First, they would crimp the tubular film containing the molten pressure sensitive at the predetermined distance. Secondly, by maintaining the chilled rollers in the crimped area, the chilled rollers would cause the molten pressure sensitive to solidify at the crimp sites, thereby isolating a predetermined amount of the hot-melt pressure sensitive adhesive between two of the crimps. To accommodate the continuous formation and filing of the tubular film, the chilled voider rolls are synchronized to move at the rate of formation of the tubular film and to crimp until solidification of the adhesive at the crimp site has occurred. Further cooling could be provided by spraying the packaging or by running the packaging through a cooled liquid.

In this latter embodiment, the chilled rollers isolate a predetermined amount of the hot-melt pressure sensitive adhesive between two of the crimps. However, the rollers do not seal the packaging at the crimp sites. It is within the scope of the present invention that the crimp sites of the packaging be subsequently clipped and that the adhesive be sold in link form or in individual packages as described above.

When a hot-melt pressure sensitive adhesive has been powder coated and releasably packaged between the two crimps, it is capable of being removed by hand from the packaging without tack and stacked in boxes for bulk sale. In yet another embodiment, which optionally does not require powder coating, the releasably packaged adhesive can be allowed to remain in the continuous tubular film which would then be boxed. At the glue pot, the user would simply cut a length of tubular film (e.g., 6 feet) having multiple blocks or bars of pressure sensitive therein. The open end of the tubular film would be lowered near the glue pot to allow blocks or bars of the releasably packaged pressure sensitive adhesive to slip into the glue pot in tandem.

In yet a further embodiment, one could combine the use of the cooled rollers and the closures to releasably package any number of isolated blocks or bars of a pressure sensitive adhesive. For example, every tenth crimp by the chilled voider rolls would be gathered, a pair of closures adjacently installed in the gathered area, and the area between the adjacent clips would be cut.

The format would allow a glue pot operator to snip off the closure at one end and allow the nine blocks or bars of the releasably packaged hot-melt pressure sensitive adhesive to slip into the glue pot without handling. Alternatively, the glue pot operator could slit the packaging and hand place each of the isolated hot-melt pressure sensitives into the glue pot.

To enhance cooling during the release packaging of the hot-melt pressure sensitive adhesive, one may optionally spray the tubular film during or after filling with the molten hot-melt pressure sensitive adhesive. If desirable, cooling may be further supplemented or enhanced by allowing the individual or linked release packages to drop into a trough of a cool liquid, such as a trough of cool water.

In certain instances, the polymer(s) of the release packaging of the present invention are adhesively compatible with the hot-melt pressure sensitive adhesive, i.e., they are capable of becoming a component of the molten hot-melt pressure sensitive adhesive without adverse effect. In such instances, it is within the scope of the present invention to place the pressure sensitive adhesive while still in its packaging, less any interfering closures, directly into the glue pot. In this embodiment, the release packaging need only have a silicone coating. If the closures are of the same material such as the polymer in the continuous film, e.g., a low density or medium density polyethylene, the release packaging with adhesive and closures could be placed directly into the glue pot in their entirety with little waste.

EXAMPLES

1. Pattern Coating Of A Master Roll

A 4,500 foot roll of a three-ply laminate film (1 mil PE/1.6 mil PET/1 mil PE) that was $51\frac{7}{8}$ inches wide (Flexicon, Inc. Cary, Ill.) was sent to Release Technologies, Inc., West Chicago, Ill. for pattern coating with silicone. The roll was pattern coated as shown in FIG. 1 except that only five preforms, instead of six, were pattern coated on one face of the three-ply film. Each pattern for the preform consisted of a silicone coated zone ("stripe") that was 7.85" wide and an adjacent uncoated zone ("stripe") that was 0.7" wide. (A 7.85" wide silicone coated zone produces a $2\frac{1}{2}$" diameter chub package). Trim areas on both sides of the pattern also remained uncoated. The described silicone coating on the laminate was performed by Release Technologies, Inc. using their ST3A electron beam cured silicone.

2. Preparation Of A Preform

The master roll of Example 1 was cut by Release Technologies to produce five rolls, each 8.55"±1/16" wide and having the pattern coating of the preform of FIG. 2. As described in Example 1, each roll of preform had a longitudinal silicone coated zone that was 7.85" wide and an uncoated zone that was 0.7" wide. Each roll of the preform was wound such that the surface of the laminate having the silicone coating faced outward.

3. Coating The Preform with Micronized Powder

A vibratory feeder (Eriez Magnetics, Ontario, Canada) was loaded with a micronized synthetic wax composed of straight chain hydrocarbons (m.p. 215°–223° F.) and having a mean particle size of 8.5 microns and a maximum particle size of 13.0 microns (Micro Powders, Inc., Tarreytown, N.Y. Cat. No. MP-26). The wax was applied to the preform by allowing the preform to feed horizontally (with its silicone coated side up) under the feeder whereupon the feeder dropped the micronized wax onto the preform at a controlled rate. The excess wax fell off the preform as it fed vertically toward the continuous form-fill-seal machine.

Similarly, on another occasion, the preform of Example 2 was powder coated with a synthetic wax having a mean particle size of 5 microns, a maximum particle size of 14 microns and a melting point of 219°–230° F. (Micro Powders, Inc., Tarreytown, N.Y. Cat. No. MP-28C).

4. Release Packaging of A Hot Melt Pressure Sensitive Adhesive

A chub packaging machine (Kartridge Pak Co., Davenport, Iowa, Model 30) was used to continuously form a $2\frac{1}{2}$" diameter tubular film from the powder coated preform of Example 3. Simultaneously, molten hot-melt pressure sensitive adhesive at a processing temperature of about 240° F. was pumped through a mandrel into the newly formed tubular film. The chub packaging machine was set in a link format whereby a single wire closure separated the isolated hot-melt pressure sensitive adhesive. The voider rolls were set to isolate between each of the two closures about 1 lb of the hot-melt pressure sensitive adhesive. Upon cooling, the links were cut and the hot-melt pressure sensitive adhesive therein was easily released from the package and safely handleable (i.e., non-tacky).

What is claimed is:

1. A method for the waste-free packaging of a hot-melt pressure sensitive adhesive composition comprising the steps of:

a. providing a preform for hot-melt adhesive composition comprising a continuous sheet of heat sealable film having two opposing longitudinal edges, namely, a first edge and an opposing edge, that are capable of forming a heat seal with one another, said continuous sheet of heat sealable film having a composition that is compatible with being integrated into the composition of said hot-melt adhesive composition;

b. heat sealing the area along the first edge of the preform to an area along the opposite edge of the preform to form a continuous tubular film capable of receiving an extruded hot-melt pressure sensitive adhesive therein; and c. extruding a hot-melt pressure sensitive adhesive into said continuous tubular film at a predetermined rate;

d. crimping said continuous tubular film at a predetermined distance such that a predetermined amount of the hot-melt pressure sensitive adhesive is isolated between at least two of the crimps to produce a compatibly packaged hot-melt adhesive composition; and e. melting said compatibly packaged hot-melt adhesive composition in a glue pot whereby said compatible packaging becomes compatibly integrated into said molten hot-melt adhesive composition.

2. The method of claim 1 wherein said crimping step is accomplished by heat sealing.

3. The method of claim 1 wherein said crimping step employs a polymeric closure that is capable of being compatibly integrated into the molten hot-melt adhesive composition.

4. The method of claim 3 wherein said polymeric closure comprises the same polymeric material as in the continuous sheet of heat sealable film.

5. The method of claim 4 wherein said polymeric closure is a low density or medium density polyethylene.

* * * * *